US008531114B2

(12) United States Patent
Deckard et al.

(10) Patent No.: US 8,531,114 B2
(45) Date of Patent: Sep. 10, 2013

(54) ILLUMINATION BEACON

(75) Inventors: Kyle W. Deckard, Bloomington, IN (US); Alexander M. Soles, Bloomington, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 266 days.

(21) Appl. No.: 13/229,945

(22) Filed: Sep. 12, 2011

(65) Prior Publication Data

US 2012/0235572 A1 Sep. 20, 2012

Related U.S. Application Data

(60) Provisional application No. 61/429,007, filed on Dec. 31, 2010.

(51) Int. Cl.
*H01J 1/60* (2006.01)

(52) U.S. Cl.
USPC ..... 315/130; 315/133; 315/200 A; 315/291

(58) Field of Classification Search
USPC ..... 315/129, 130, 133, 200 A, 291, 294, 315/297, 307, 360, 362; 362/184, 205, 276
See application file for complete search history.

(56) References Cited

U.S. PATENT DOCUMENTS

| | | | | |
|---|---|---|---|---|
| 5,149,190 | A | 9/1992 | MacKenzie | |
| 5,400,008 | A | 3/1995 | Toohey | |
| 5,804,829 | A | 9/1998 | Palmer | |
| 5,932,856 | A | 8/1999 | Lopes et al. | |
| 6,249,089 | B1 * | 6/2001 | Bruwer | 315/200 A |
| 6,483,439 | B1 | 11/2002 | Vukosic | |
| 6,932,496 | B2 | 8/2005 | Rizkin et al. | |
| 6,953,260 | B1 * | 10/2005 | Allen | 362/194 |
| 7,015,654 | B1 * | 3/2006 | Kuhlmann et al. | 315/291 |
| 7,158,020 | B2 | 1/2007 | Grady, Jr. | |
| 7,357,530 | B2 | 4/2008 | Wang et al. | |
| 7,581,854 | B2 | 9/2009 | Ford | |
| 7,623,026 | B2 | 11/2009 | Martin, Jr. et al. | |
| 7,744,246 | B2 | 6/2010 | Rizkin et al. | |
| 7,794,124 | B2 | 9/2010 | Hulsey et al. | |
| 7,804,251 | B2 | 9/2010 | Wang | |
| 2009/0073697 | A1 | 3/2009 | Peck et al. | |
| 2010/0026578 | A1 | 2/2010 | Furnanz et al. | |

OTHER PUBLICATIONS

Pegasus™ 2AA programmable infrared signaling beacon information sheet, Cejay Engineering, LLC, Jul. 2010, 1 pg.
Pegasus™ 4 multi-channel programmable infrared signaling beacon information sheet, Cejay Engineering, LLC, Jan. 2010, 1 pg.

(Continued)

*Primary Examiner* — Tung X Le
(74) *Attorney, Agent, or Firm* — Christopher A. Monsey

(57) ABSTRACT

An illumination beacon including a housing including a transparent top surface and a transparent bottom surface. An upper mounting member is supported within the housing proximate the transparent top surface, and a lower mounting member supported within the housing proximate the transparent bottom surface. An upper light source is supported by the upper mounting member and oriented to project light upwardly through the transparent top surface, and a lower light source is supported by the lower mounting member and oriented to project light downwardly through the transparent bottom surface. A battery is received within the housing intermediate the upper mounting member and the lower mounting member. A power management system is operably coupled to the battery.

44 Claims, 15 Drawing Sheets

(56) References Cited

OTHER PUBLICATIONS

Pegasus™ 6 Programmer information sheet, Cejay Engineering, LLC, Aug. 2009, 1 pg.

Phoenix™ Jr. infrared marker beacon information sheet, Cejay Engineering, LLC, Jan. 2010, 1 pg.

Phoenix™ 1.5 programmable infrared signaling beacon information sheet, Cejay Engineering, LLC, Apr. 2010, 1 pg.

* cited by examiner

ILLUMINATION BEACON

CROSS-REFERENCE TO RELATED APPLICATION

This application claims priority to U.S. Provisional Patent Application Ser. No. 61/429,007, filed Dec. 31, 2010, the disclosure of which is expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon.

BACKGROUND AND SUMMARY OF THE DISCLOSURE

The present disclosure relates generally to hand deployable illumination beacons and, more particularly, to a light weight, field modifiable illumination beacon.

Traditionally, infrared illumination beacons are used to emit a covert signal that is visible at long ranges by the use of night vision equipment. These illumination beacons may be used for a variety of purposes including identification of landing zones, roadways, obstructions, aircraft, vehicles, personnel, etc. However, such conventional illumination beacons may experience problems with respect to power management, including the use of large batteries in order to achieve a desired lifespan. Such large batteries may compromise the covert nature of the beacon and may be accidentally disconnected when in use, thereby hindering performance and reliable operation. Further, many prior illumination beacons are not designed for field deployment in that their respective batteries may become loose or disengaged when thrown or placed in water. Many traditional illumination beacons also have limited infrared visibility ranges. Additionally, often illumination beacons do not utilize effective placement of light sources such that field deployment of the beacons must be precise in order to provide proper signal coverage. Additionally, many prior art illumination beacons are not field customizable, nor may they be activated by a variety of external, including remotely located, triggering means.

According to an illustrative embodiment of the present disclosure, an illumination beacon includes a housing having an outer wall with a center plane defined by a circle, the housing further including a transparent top surface and a transparent bottom surface. An upper mounting member is supported within the housing intermediate the transparent top surface and the transparent bottom surface. A lower mounting member is supported within the housing intermediate the upper mounting member and the transparent bottom surface. An upper light source is supported by the upper mounting member and is oriented to project light upwardly through the transparent top surface. A lower light source is supported by the lower mounting member and is oriented to project light downwardly through the transparent bottom surface. A driver system is received within the housing and is operably coupled to the upper and lower light sources, the driver system being configured to activate the upper and lower light sources. A controller is received within the housing and is operably coupled to the driver system, the controller being configured to control operation of the driver system for activating the upper and lower light sources in a flashing manner. A battery is received within the housing intermediate the upper mounting member and the lower mounting member, the battery being operably coupled to the driver system for providing power to the upper and lower light sources. A power management system is operably coupled to the battery. The power management system includes a signal generator coupled to the battery and configured to generate first and second voltage signals, and an inductor coupled to the signal generator. The inductor selectively stores energy from the battery in response to the first voltage signal from the signal generator, and provides energy to power the upper and lower light sources in response to the second voltage signal to increase energy efficiency of the battery.

According to another illustrative embodiment of the present disclosure, a illumination beacon includes a housing, a mounting member supported within the housing, and a light source supported by the mounting member and oriented to project a non-visible light external to the housing. A controller is received within the housing and is operably coupled to the light source, the controller being configured to activate the light source in one of a plurality of flashing modes. A battery is received within the housing and is operably coupled to the light source. A mode select interface is operably coupled to the controller, the controller being configured to select a flashing mode of the light source in response to input to the mode select interface. An external trigger system is operably coupled to the controller, the controller being configured to activate the light source in response to input to the external trigger system. A status indicator is operably coupled to the controller and is configured to project a visible light external to the housing in response to input to at least one of the mode select interface and the external trigger system.

According to a further illustrative embodiment of the present disclosure, an illumination beacon includes a housing having an outer wall with a center plane defined by a circle, the housing further including a transparent top surface and a transparent bottom surface. An upper mounting member is supported within the housing intermediate the transparent top surface and the transparent bottom surface. A lower mounting member is supported within the housing intermediate the upper mounting member and the transparent bottom surface. An upper light source is supported by the upper mounting member and is oriented to project light upwardly through the transparent top surface. A lower light source is supported by the lower mounting member and is oriented to project light downwardly through the transparent bottom surface. A controller is received within the housing and is operably coupled to the upper and lower light sources, the controller being configured to control operation of the upper and lower light sources in a flashing manner. A battery holder is positioned intermediate the upper mounting member and the lower mounting member, the battery holder including a positive terminal and a negative terminal. A coin cell battery is removably received within the battery holder for electrical communication with the positive terminal and the negative terminal for providing power to the upper and lower light sources. The housing has an outer diameter of no greater than 1 inch.

According to another illustrative embodiment of the present disclosure, a method of providing a light signal includes the steps of providing a housing, a light source within the housing, and a status indicator within the housing. The method further includes providing an input to a mode select interface, and illuminating the status indicator to project a visible light external to the housing. The method also includes the steps of illuminating the light source to project a non-visible light external to the housing in one of a plurality of different flashing patterns based upon the input to the mode select interface, and supplying power to the status indicator and the light source from a battery. The method further includes the steps of generating voltage signals, storing energy from the battery in a storage device in response to a first voltage signal, and supplying energy from the energy storage device to the status indicator and the light source in response to a second voltage signal.

BRIEF DESCRIPTION OF THE DRAWINGS

The foregoing aspects and many of the attendant advantages of this invention will become more readily appreciated as the same become better understood by reference to the following detailed description when taken in conjunction with the accompanying drawings.

Figure 1:
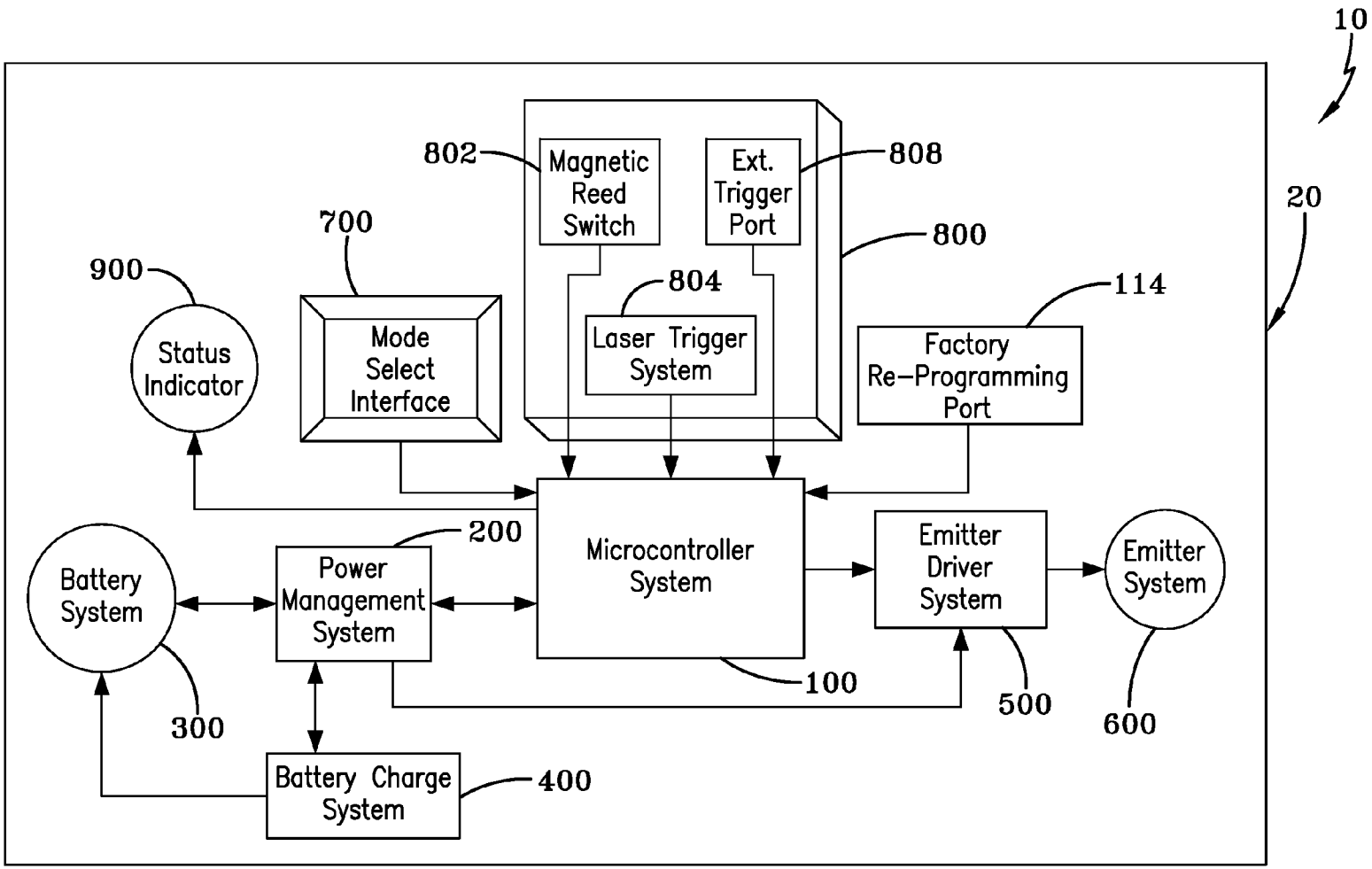
FIG. 1 is a block diagram of an operating system of an illustrative illumination beacon of the present disclosure.

Corresponding reference characters indicate corresponding parts throughout the several views. Although the drawings represent embodiments of various features and components according to the present disclosure, the drawings are not necessarily to scale and certain features may be exaggerated in order to better illustrate and explain the present disclosure. The exemplification set out herein illustrates embodiments of the invention, and such exemplifications are not to be construed as limiting the scope of the invention in any manner.

DETAILED DESCRIPTION OF THE DRAWINGS

For the purposes of promoting an understanding of the principles of the invention, reference will now be made to the embodiments illustrated in the drawings, which are described below. The embodiments disclosed below are not intended to be exhaustive or limit the invention to the precise form disclosed in the following detailed description. Rather, the embodiments are chosen and described so that others skilled in the art may utilize their teachings. It will be understood that no limitation of the scope of the invention is thereby intended. The invention includes any alterations and further modifications in the illustrated devices and described methods and further applications of the principles of the invention which would normally occur to one skilled in the art to which the invention relates.

Figure 2:
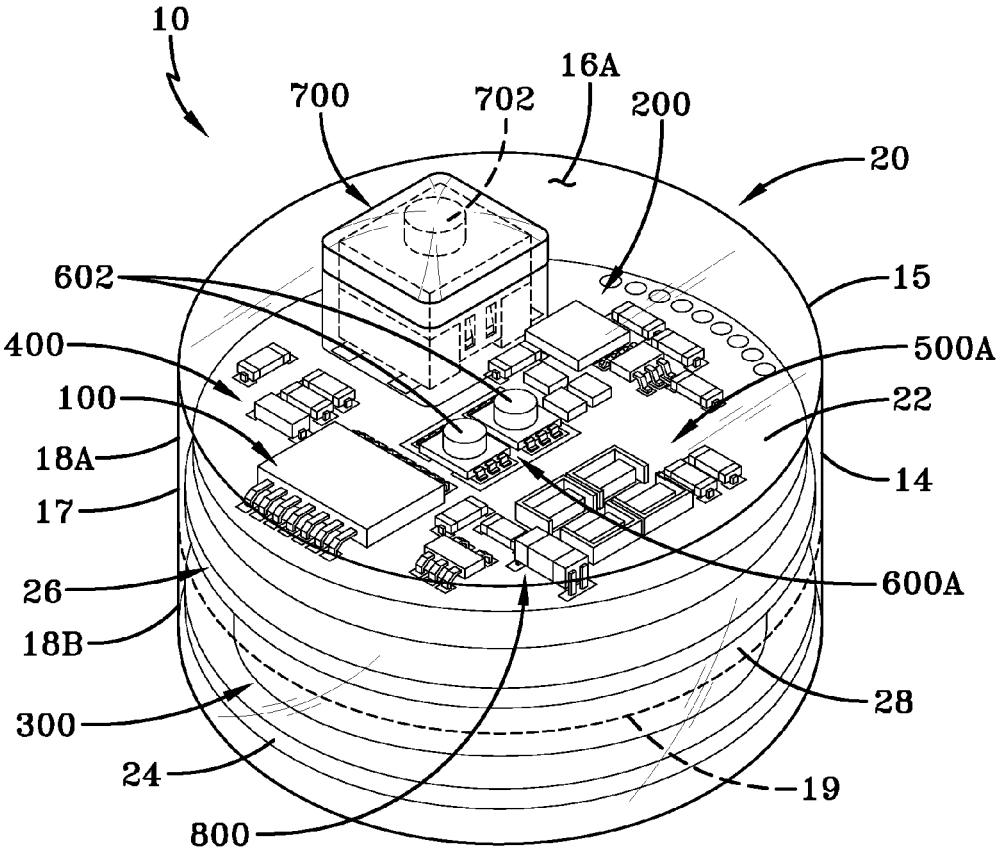
FIG. 2 is a top perspective view of an illustrative illumination beacon of the present disclosure.
Figure 3:
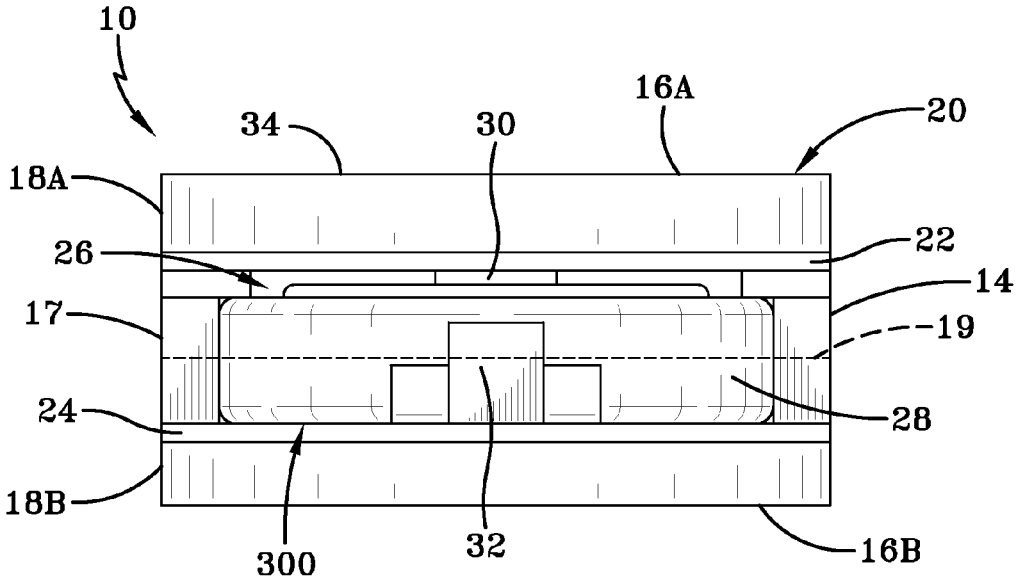
FIG. 3 is a side elevational view of the illumination beacon of FIG. 2.

Referring initially to FIGS. 1-3, an illustrative illumination beacon 10 of the present disclosure includes a housing 12 receiving an operating system 20. As further detailed herein, the housing 12 is illustratively sealed from the environment to prevent dirt and/or water from contacting the electronics of the operating system 20.

As shown in FIGS. 2 and 3, the illustrative housing 12 includes an outer wall 14 having arcuate portions, illustratively a circular cross-section (i.e., a center plane defining a circle 15). The housing 12 further includes a transparent top surface 16*a* and a transparent bottom surface 16*b* illustratively connected by a transparent side wall 17. The housing 12 may be formed of any durable, light weight material. In one illustrative embodiment, the housing 12 is formed of a molded polymer, such as a thermoplastic with clear or infrared (IR) transparent polymer windows for permitting the transmission of light from IR emitters. More particularly, the housing 12 may be formed of symmetrical upper and lower portions 18*a* and 18*b* that are secured together along a coupling line 19, illustratively through conventional securing means such as adhesives or heat welding, in order to provide a sealed environment for the operating system 20. In other illustrative embodiments, the coupling line 19 may be formed of a releasable securing means, such as mating threads between the upper and lower portions 18*a* and 18*b*. Due to its rugged, sealed design, the illumination beacon 10 may be used in a variety of harsh and/or underwater environments.

In the illustrative embodiment, the housing 12 is in the form of a puck where the side wall 17 is cylindrical in nature and the top and bottom surfaces 16*a* and 16*b* are substantially planar. In such a configuration, the side wall 17 has an outer diameter of approximately 1 inch and a height of approximately 0.5 inches. The illumination beacon 10, including housing 12 and operating system 20, illustratively has a total weight of approximately 0.5 ounces. In an alternative embodiment, the top and bottom surfaces 16*a* and 16*b* may be convex in shape, such that the housing 12 defines a sphere. The circular cross-section of outer wall 14 assists in field deployment of the illumination beacon 10 by permitting the user to place, throw or roll the housing 12. For example, the illumination beacon 10 may be rolled along the cylindrical side wall 17 to a desired target.

An upper mounting member 22 is supported within the housing 12 proximate the transparent top surface 16*a*. Similarly, a lower mounting member 24 is supported within the housing 12 proximate the transparent bottom surface 16*b*. Each of the mounting members 22 and 24 illustratively comprise a printed circuit board (PCB) including an electrically insulating substrate supporting conductive traces.

With further reference to FIGS. 1-4B, a microcontroller system 100 is illustratively supported by the upper mounting member 22 and is in electrical communication with a power management system 200. The power management system 200 is in electrical communication with a battery system 300 and a battery charge system 400. The microcontroller system 100 is also in communication with an emitter driver system 500 which, in turn, controls an optical emitter system 600. More particularly, a first or upper emitter driver 500A controls a first or upper emitter system 600A, while a second or lower emitter driver 500B controls a second or lower emitter system 600B. A mode select interface 700 is also in communication with the microcontroller system 100. The microcontroller system 100 may also be in communication with an external trigger system 800 and a status indicator 900.

Figure 5:
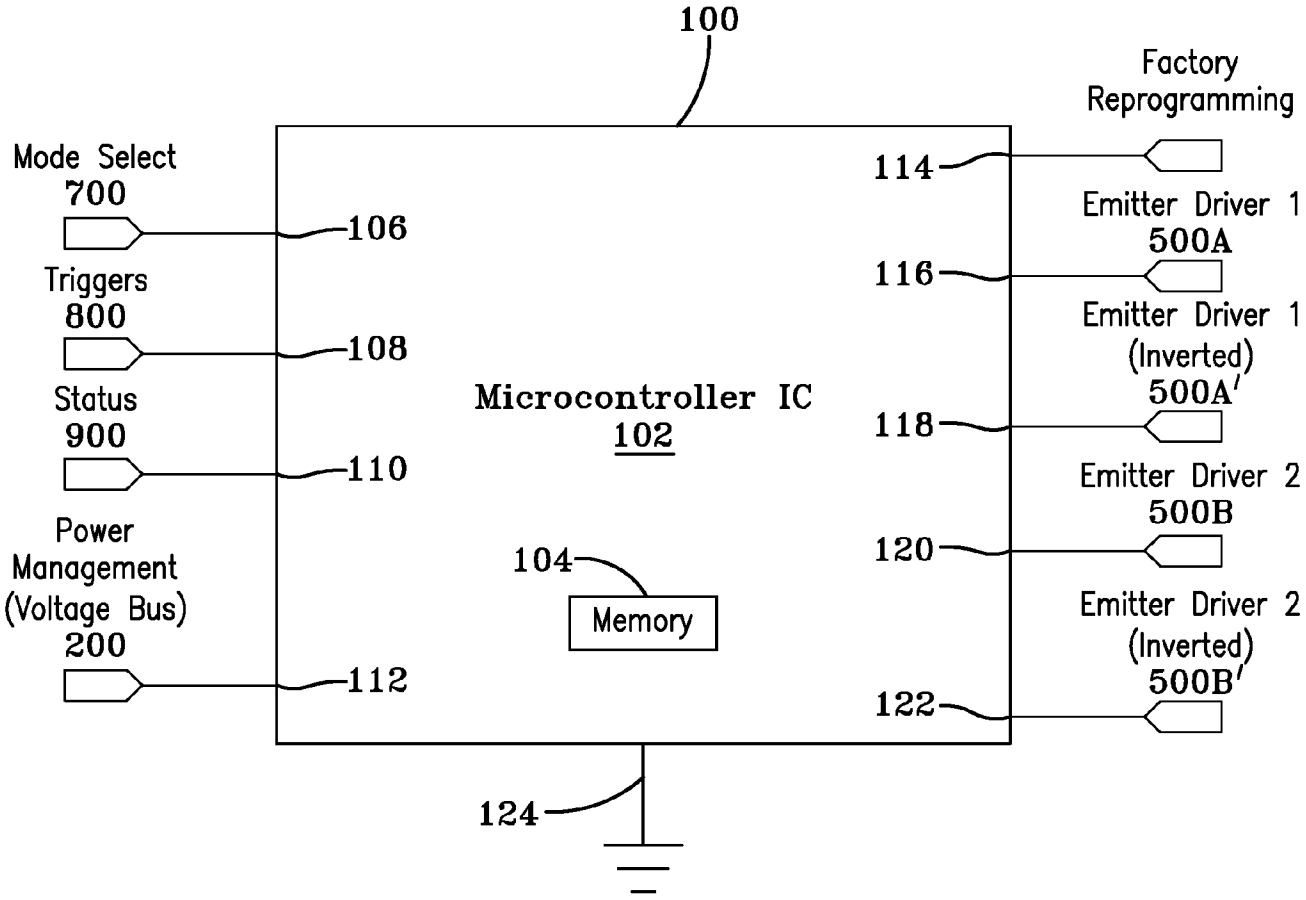
FIG. 5 is a schematic view showing illustrative connections to the microcontroller of the operating system of FIG. 1.

With reference to FIG. 5, the microcontroller system 100 includes a processor 102, illustratively a microcontroller integrated chip (IC) having a memory 104. The processor 102 illustratively includes a plurality of electrical terminals or ports to other components of the operating system 20. The mode select interface 700 may be coupled to port 106, while the external trigger system 800 may be coupled to port 108. Status indicator 900 may be coupled to port 110, and power management system 200 may be coupled to port 112, illustratively through a voltage bus 202. A factory reprogramming port 114 provides for communication between the processor 102 and an external computer for reprogramming operating characteristics of the processor 102. The first emitter driver 500A is coupled to ports 116 and 118, while the second emitter driver 500B is coupled to ports 120 and 122. Processor 102 is illustratively coupled to electrical ground 124. The processor 102 also illustratively includes a timer or clock which may be used to deactivate (i.e., power-down) or change operating modes of the illumination beacon 10 after a predetermined time of operation.

As further detailed herein, the processor 102 may be programmed to operate the optical emitter system 600 as desired by the user. For example, code instructions to control operation of the emitter driver system 500 may be uploaded to the memory 104 of the processor 102. Illustratively, the code instructions of the processor 102 may provide for multiple mode control, wherein each mode may have different flash rates and/or patterns (codes) of the light sources 602 and 604. Identification of friend or foe (IFF) information may also be provided to processor 102. IFF is an identification system traditionally utilized for command and control that enables military and civilian (e.g., transponders onboard aircraft) interrogation systems to distinguish between friendly and foe (unfriendly) aircraft, vehicles, or forces. IFF systems may be encrypted with a special key, such that IFF transponders with the same special key will be able to decode and respond (e.g., relay messages). A major benefit of IFF is to positively identify friendly forces and to prevent friendly fire incidents.

As noted above, data, such as code instructions, may be provided to memory 104 of microcontroller system 100 through factory reprogramming port 114. The factory reprogramming port 114 may include an on-board upper connection header 114A including terminals or ports 116, and an on-board lower connection header 114B including terminals or ports 116.

Figure 6:
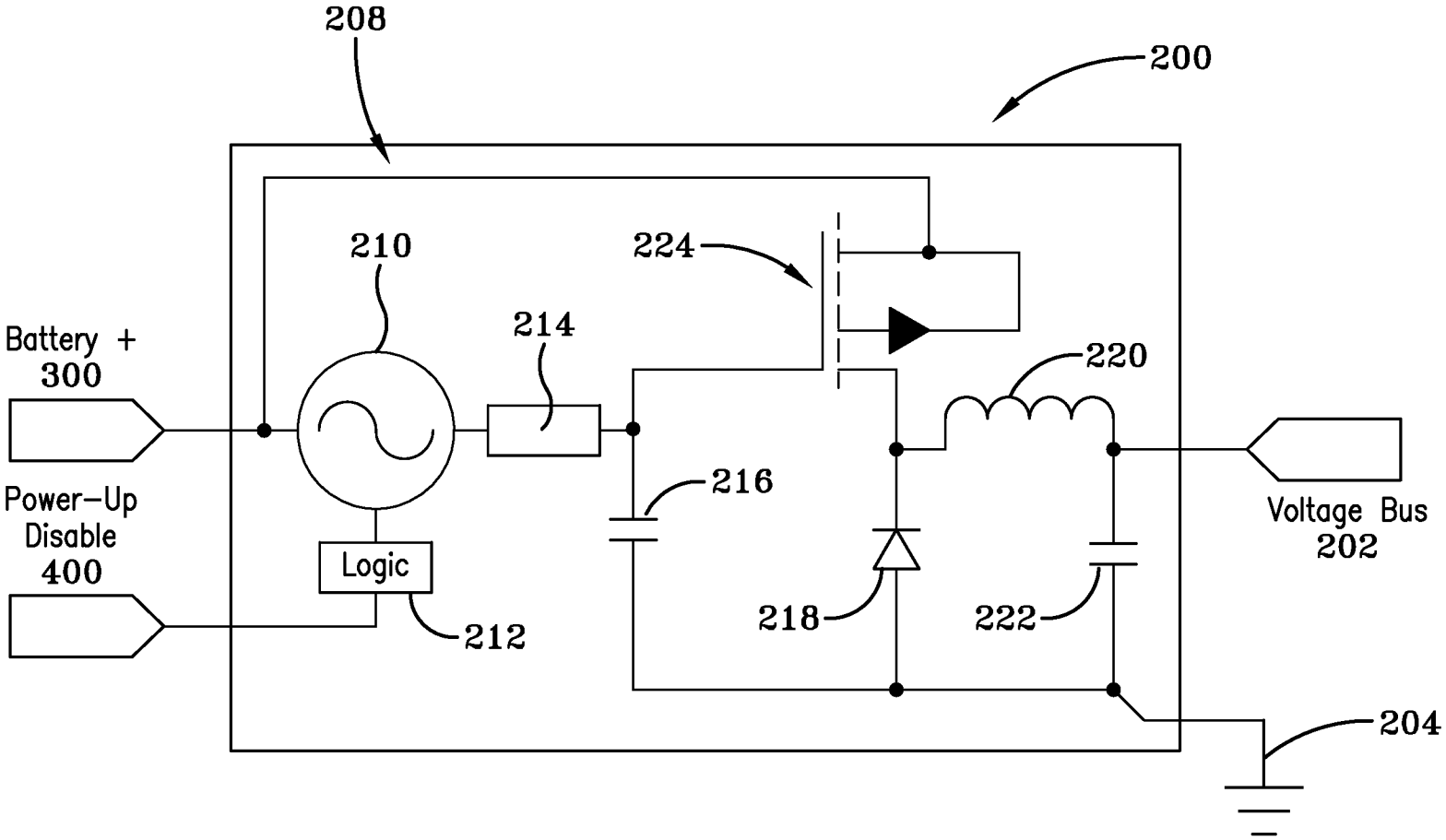
FIG. 6 is a schematic of an illustrative power management system of the operating system of FIG. 1.

Referring to FIG. 6, the power management system 200 includes an exemplary boost/buck converter 208 providing a regulated DC power supply at voltage bus 202 for illumination beacon 10. Power management system 200 is configured to extend the life of battery 300 by providing efficient power to the load devices of beacon 10. Boost/buck converter 208 illustratively includes a signal generator 210, a logic device 212, a half-wave rectifier 214, capacitors 216 and 222, an inductor 220, and two switches 224 and 218. A boost/buck converter 208, illustratively is a device that is configured to produce an output voltage magnitudes larger than an input voltage. The boost/buck converter 208 is particularly useful when connected in line with a battery powered application as it allows the output voltage to remain consistent even though the battery voltage is dropping over time. In the illustrative embodiment, the boost/buck converter 208 essentially conditions and delivers the power from the battery 28 to the electrical circuits of the illumination beacon 10. Within the boost/buck converter 208, there are several traditional functionalities such as a power-up disable 400 and an interfacing logic device 212. The power-up disable 400 and logic device 212 act in tandem (if enabled by a signal) to keep the boost/buck converter 208 in the off state (disabled) and drawing little or no power while disabled.

Switch 218 is illustratively a diode, and switch 224 is illustratively a transistor. An exemplary transistor 224 is an enhancement mode, p-channel MOSFET transistor. In the illustrated embodiment, the signal generator 210 and the rectifier 214 cooperate to provide a square-wave voltage signal to the input of transistor 224 having alternating "high" and "low" voltage levels. In a first mode when a "high" voltage level is at the input of transistor 224, voltage from the battery 300 is provided directly to the inductor 220 through the transistor 224, and the diode 218 is reverse biased. As a result, the inductor 220 accumulates stored energy, and charged capacitor 222 provides power to the voltage bus 202. In a second mode when a "low" voltage level is at the input of transistor 224, the connection between the battery 300 and the inductor 220 is removed by the transistor 224. As a result, the diode 218 is forward biased and the stored energy in the inductor 220 provides power to the voltage bus 202.

Figure 7:
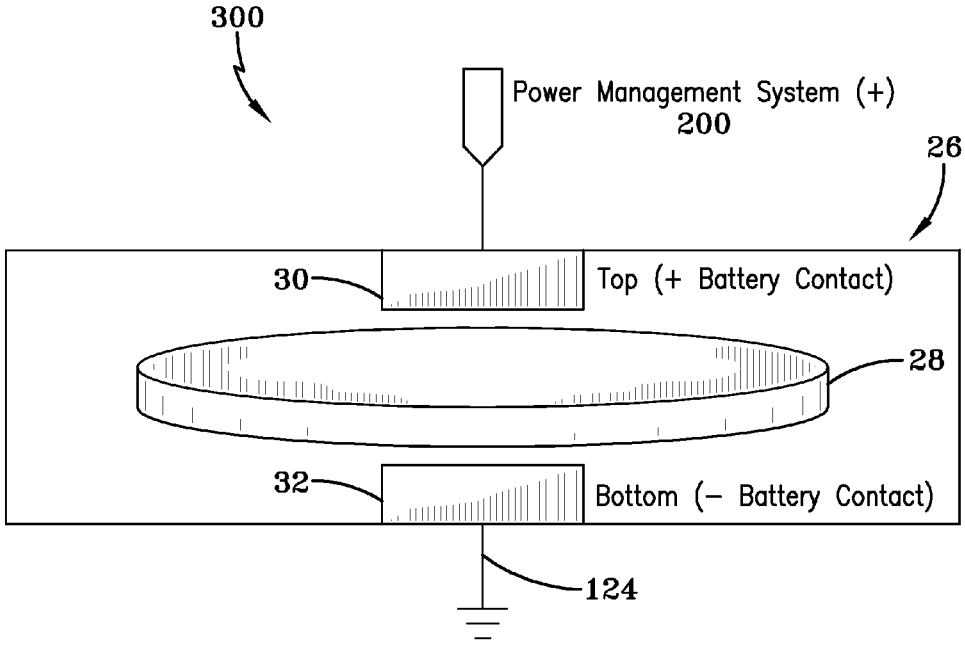
FIG. 7 is a diagrammatic view of an illustrative battery system of the operating system of FIG. 1.

With reference to FIGS. 3 and 7, the battery system 300 illustratively comprises a coin cell battery 28 having a compact profile and a disc shape. A battery holder 26 is positioned intermediate the upper mounting member 22 and the lower mounting member 24. The battery holder 26 includes a positive contact 30 and a negative contact 32 for electrically communicating with the battery 28. More particularly, the top battery contact 30 is in communication with the power management system 200, while the bottom battery contact 32 is coupled to electrical ground 124. The battery holder 26 may releasably secure the battery 28 within the housing 12, such that the battery 28 may be replaced when depleted.

Illustratively, the battery 28 comprises a lithium ion battery to provide enhanced performance and reduced size. In one illustrative embodiment, the battery 28 comprises a CR2450 Li-Ion (3 volt 610 m Ah) battery. Such lithium ion batteries exhibit superior temperature range tolerances, long storage life, excellent current source capabilities, and stable voltage output over their operational lifetimes. For example, illustrative generic lithium ion coin cell batteries 28 can survive in temperatures ranging from −20 degrees Celsius to 70 degrees Celsius, while providing good source capabilities from 2 milliamps continuous to as much as 30 milliamps in pulsed operation. Storage lifetime of battery 28 is illustratively upwards of 5.3 years at room temperature before cell and resulting output voltage degradation occurs. Generic baseline data for the CR2450 lithium ion coin cell battery is provided by FDK/Sanyo Batteries.

Figure 8:
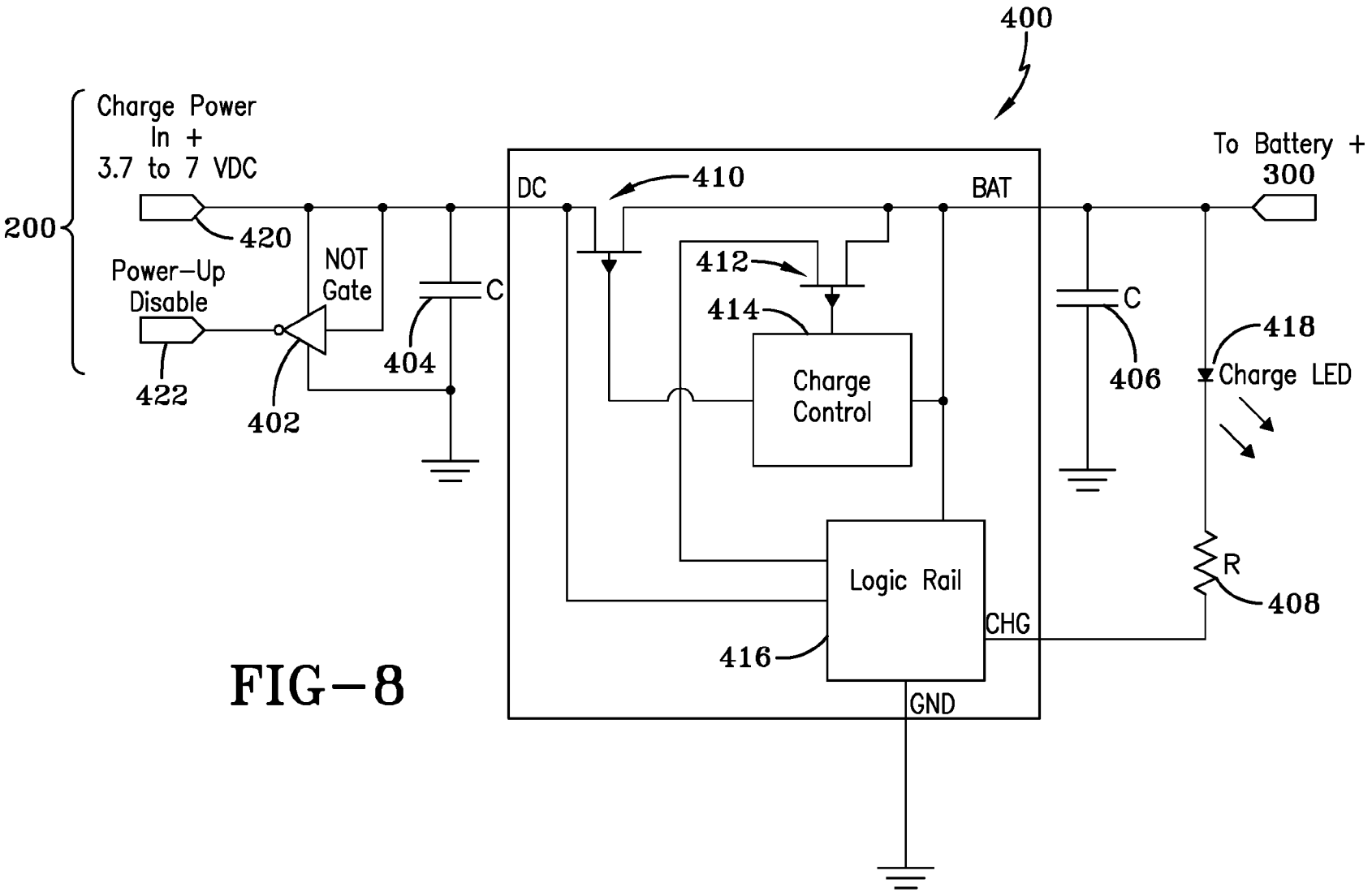
FIG. 8 is a schematic view of an illustrative battery charge system of the operating system of FIG. 1.

Referring to FIG. 8, an exemplary battery charge system 400 is provided for charging a rechargeable lithium ion type coin cell battery 28. Battery charge system 400 illustratively includes a controller 414, a logic rail 416, and two transistors 410, 412. Transistors 412, 414 are illustratively p-channel type JFET transistors, although other suitable transistors may be used. Battery charge system 400 further includes a logic NOT gate 402, capacitors 404, 406, a resistor 408, and a charge indicator 418. Charge indicator 418, illustratively an LED 418, is configured to illuminate during a charging operation of battery 300.

External power input 420 and power-up disable flag 422 are provided as inputs to battery charge system 400. Battery charge system 400 may be purchased in a COTS (commercial-off-the-shelf) manner or custom built to provide a battery chemistry specific charging operation. When the battery charge system 400 is energized with a power source, it checks the voltage of battery 300. If the battery voltage is below a preset threshold, then the battery charge system 400 fast charges the battery 28 at a constant current (current regulating mode). Battery 28 may enter float charge (float mode) when the total battery terminal voltage reaches the voltage limit, which signifies that the battery 28 has completed the charge. The logic rail 416 checks the voltage of the battery 28 and determines if the connected charge control 414 needs to operate in float mode or a current regulation mode. The logic rail 416 may also display the charge state information to an indicator LED 418. An illustrative example of a COTS lithium ion battery charge system 400 is Maxim IC's MAX1555.

Figure 9:
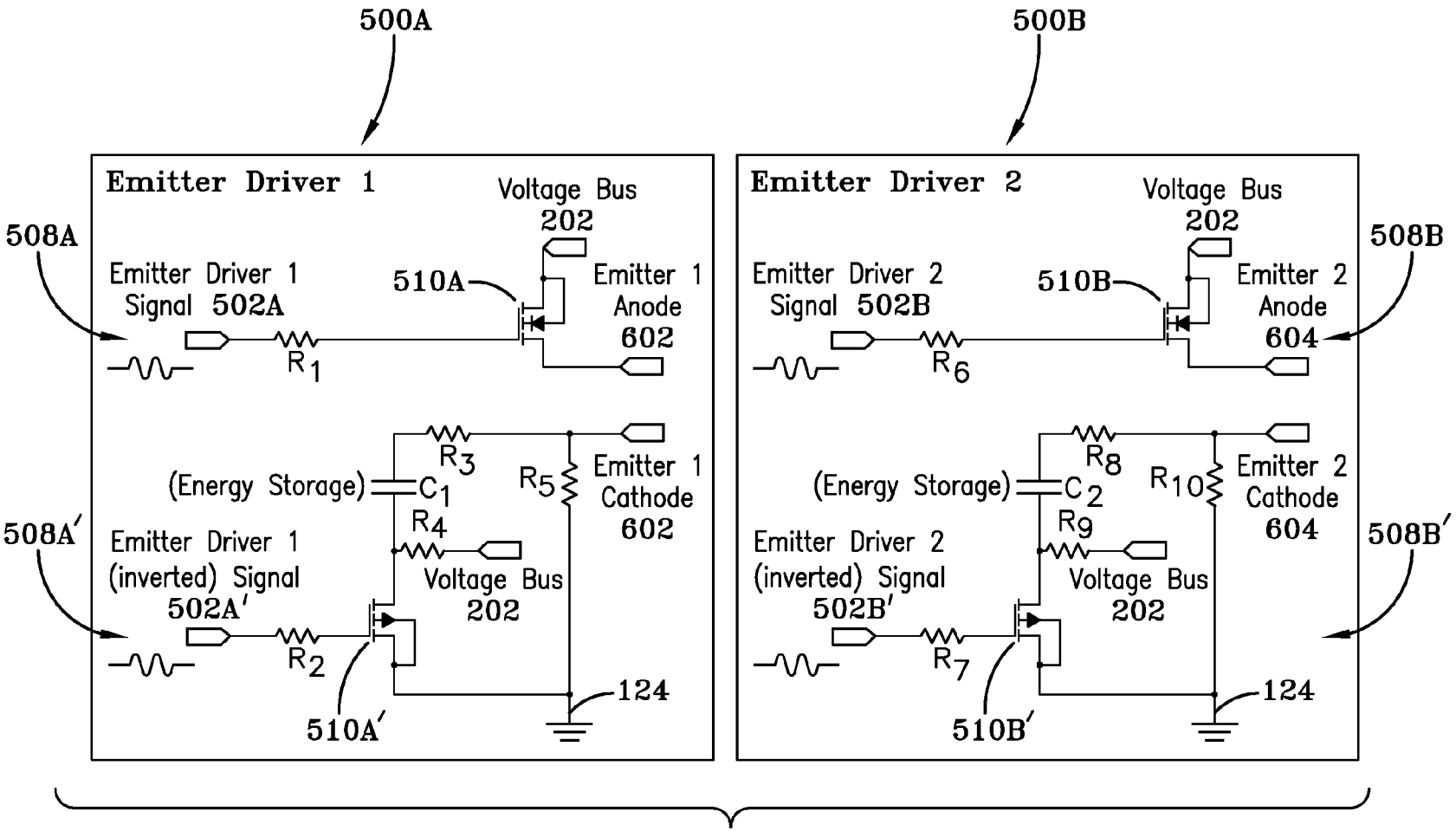
FIG. 9 is a schematic view of an illustrative emitter driver system of the operating system of FIG. 1.

Referring to FIG. 9, the illustrative emitter driver system 500 is configured to receive signals from the microcontroller system 100 to control activation of the emitter system 600. In the illustrative embodiment, the emitter driver system 500 is configured in such a way to utilize a charge pump based mechanism to push higher amounts of output current to the light sources 602 and 604. The amount of output current is typically higher than a standard lithium ion coin cell battery can source, thus allowing the light sources 602 and 604 to output the maximum amount of light according to its own manufacturer specifications.

During the charging phase, the input emitter signal pulse waves 502A and 502A' into circuits 508A and 508A' allow transistors 510A and 510A' to enter into their off states, thus permitting capacitor $C_1$ to charge in a current regulated fashion dictated by (voltage bus 202/($R_4$+$R_3$+$R_5$)). When transistors 510A and 510A' enter into the on state by the input emitter signal pulse waves 502A and 502A' into circuit 508A and 508A', capacitor $C_1$ discharges through the light source 602 and $R_3$ in tandem with the voltage bus 202 and ground 124 dictated by ((Voltage at capacitor $C_1$+voltage bus 202)/$R_3$). The cycle then repeats according to the duty cycle of the input emitter signal pulse waves 502A and 502A' into circuit 508A and 508A'.

The emitter driver system 500 of FIG. 1 includes a first emitter driver 500A and a second emitter driver 500B, each including a first circuit 508A, 508B and a second circuit 508A', 508B', respectively. First circuit 508A of emitter driver 500A is configured to provide voltage to the anode of one or more emitters 602 of a top emitter system 600A (shown in FIG. 10). Second circuit 508A' of emitter driver 500A is configured to connect the cathode of one or more emitters 602 of top emitter system 600A (see FIG. 10) to electrical ground 124. Similarly, first circuit 508B of emitter driver 500B is configured to provide voltage to the anode of one or more emitters 604 of a bottom emitter system 600B (shown in FIG. 10). Second circuit 508B' of emitter driver 500B is configured to connect the cathode of one or more emitters 604 of bottom emitter system 600B (see FIG. 10) to electrical ground 124. Emitter driver 500B functions in the same way as emitter driver 500A. As such, the following description of emitter driver 500A also applies to emitter driver 500B.

Referring to first circuit 508A of emitter driver 500A, a resistor $R_1$ is connected between an output of microcontroller 100 (see terminal 116 of FIG. 5) and the input of a transistor 510A. An exemplary transistor 510A is an enhancement mode, n-channel MOSFET transistor. When transmitter 510A enters the on state by signal 502A provided from microcontroller 100, voltage from voltage bus 202 is provided to the anode of one or more emitters 602 of top emitter system 600A (see FIG. 10). Additional details of the operation of first circuit 508A are provided above.

Second circuit 508A' includes a transistor 510A', resistors $R_1$ through $R_5$, and a capacitor $C_1$. An exemplary transistor 510A is an enhancement mode, p-channel MOSFET transistor. As further detailed above, when signal 502A' is provided from terminal 118 of microcontroller 100 to the circuit 508A', transistor 510A' enters into its off or on state according to the duty cycle of the input emitter signal pulse waves 502A'.

Figure 4B:
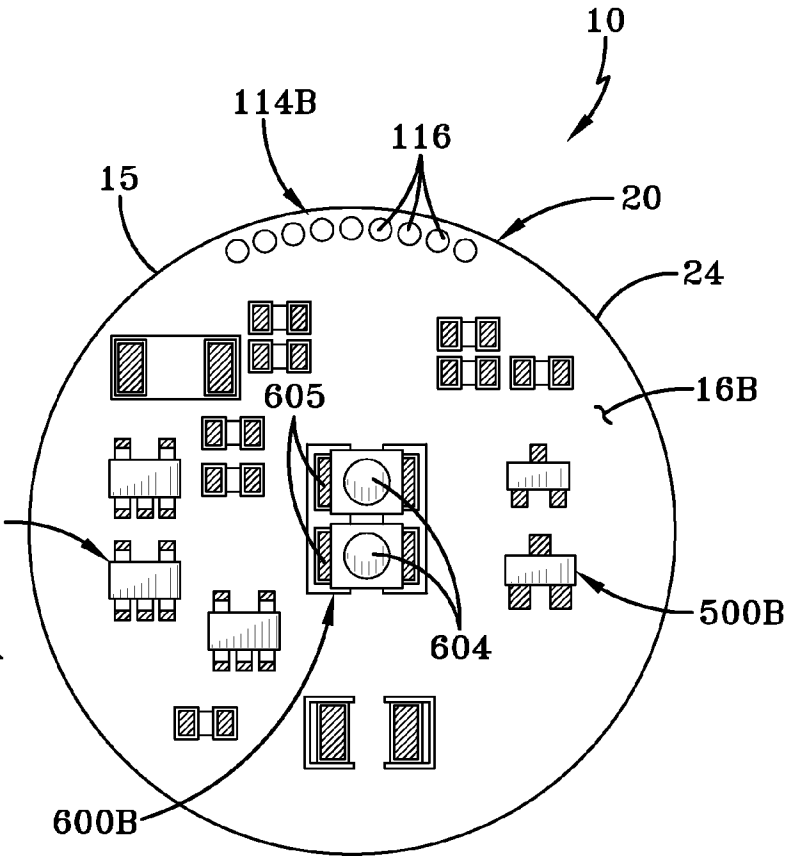
FIG. 4B is a bottom plan view of the illumination beacon of FIG. 2.
Figure 4A:
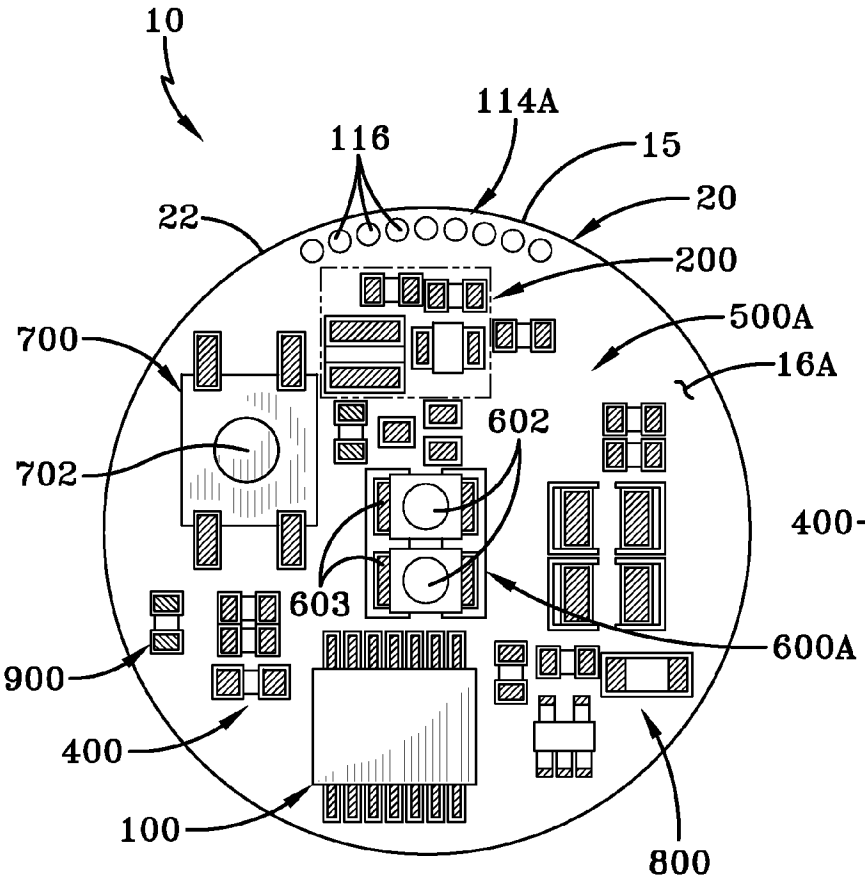
FIG. 4A is a top plan view of the illumination beacon of FIG. 2.

With reference to FIGS. 4A and 4B, the emitter system 600 illustratively comprises upper emitter system 600A supported by the upper mounting member 22 and lower emitter system 600B supported by the lower mounting member 24. Both the upper and the lower emitter systems 600A and 600B illustratively include optical emitters or light sources 602 and 604 supported within couplers or sockets 603 and 605 supported by mounting members 22 and 24, respectively. The light sources 602 and 604 extend upwardly and downwardly, respectively, from mounting members 22 and 24. The light sources 602 and 604 project light through the transparent upper and lower surfaces 16*a* and 16*b*. The placement and orientation of the light sources 602 and 604 (e.g., upwardly and downwardly from mounting member 22 and 24, respectively), promotes light exposure no matter the placement of the illumination beacon 10 (e.g., resting on surface 16*a* or surface 16*b*).

Figure 10:
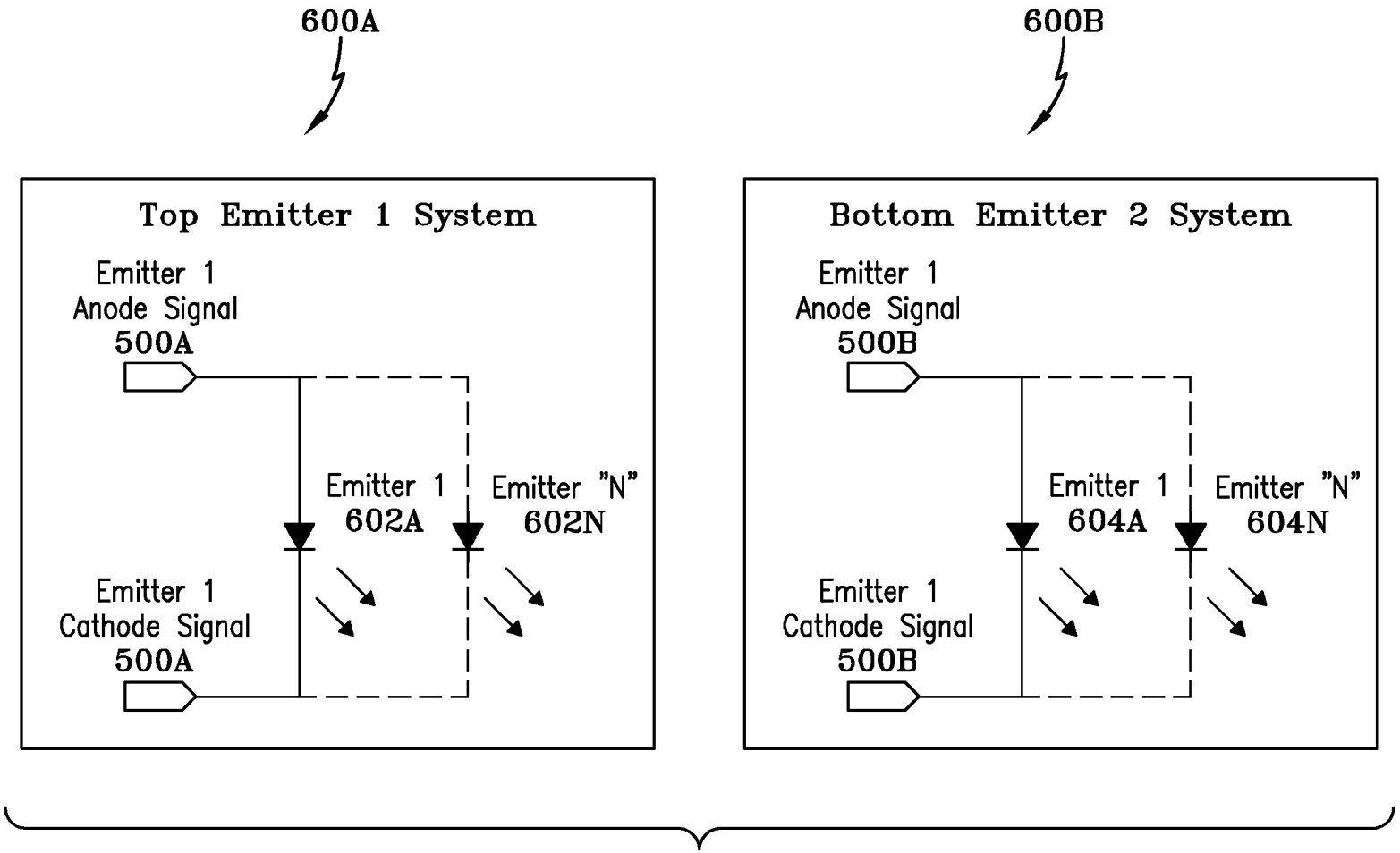
FIG. 10 is a schematic view of an illustrative emitter system of the operating system of FIG. 1.

Referring now to FIG. 10, top and bottom emitter systems 600A, 600B may each illustratively include a plurality of emitters 602A-N and emitters 604A-N, respectively. Upon emitter driver 500A of FIG. 9 providing a voltage signal to the anodes of emitters 602A-N and connecting the cathodes of emitters 602A-N to ground, emitters 602A-N of top emitter system 600A illuminate. Similarly, upon emitter driver 500B of FIG. 8 providing a voltage signal to the anodes of emitters 604A-N and connecting the cathodes of emitters 604A-N to ground, emitters 604A-N of bottom emitter system 600B illuminate.

As noted above, each emitter 602 and 604 illustratively comprises a light source removably coupled to socket 603, 605 on respective mounting member 22, 24. As such, the light sources 602 and 604 may be interchanged, for example between invisible light sources (e.g., infrared and ultraviolet) and visible light sources. More particularly, the illumination beacon 10 may be outfitted with light sources having wavelengths and operations that are customizable by the user. The power output, visibility, and range of the light sources may be matched to specific user requirements.

In one illustrative embodiment, the light sources 602 and 604 comprise infrared light sources generating light having a wavelength of 800 nm and an intensity of between 30 to 400 mw/sr. In another illustrative embodiment, the light sources 602 and 604 may comprise ultraviolet light sources generating light having a wavelength of 350 nm. In yet another illustrative embodiment, the light sources 602 and 604 may comprise visible light sources generating light having a wavelength of 550 nm.

Figure 11:
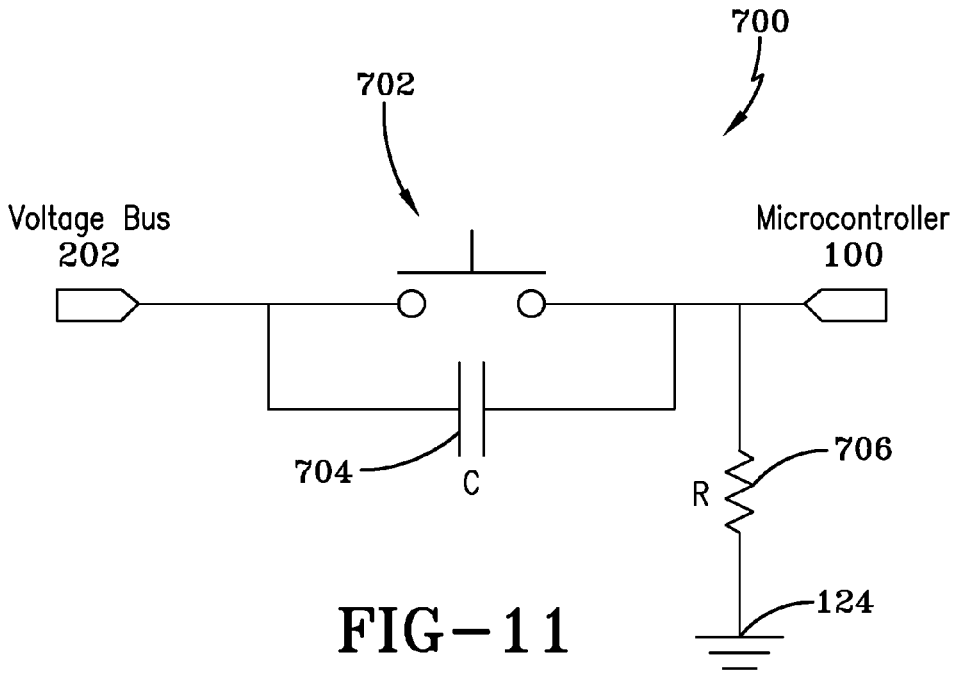
FIG. 11 is a schematic view of an illustrative mode select interface of the operating system of FIG. 1.

Referring to FIG. 11, the mode select interface 700 is operably coupled to the microcontroller system 100, wherein the microcontroller system 100 is configured to select different operating modes of the upper and lower emitter systems 600A and 600B in response to upper input to the mode select interface 700. In one illustrative example, the mode select interface 700 includes a push button or switch 702 accessible external to the housing 12, wherein depressing the button 702 once results in activation of the light sources 602 and 604. As further detailed herein, depressing the button 702 sequential times will result in different operating modes (i.e., flashing rates and patterns/codes) being selected by the microcontroller system 100.

Figure 12:
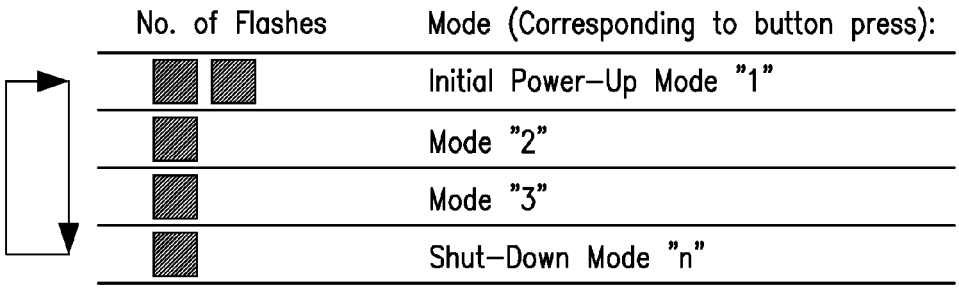
FIG. 12 is a table illustrating indicator status corresponding to operation of the mode select interface of FIG. 11.

More particularly, FIGS. 11 and 12 illustrate a mode switching scheme of illumination beacon 10. Referring to FIG. 11, mode select interface 700 is connected to an input of microcontroller 100. Mode select interface 700 illustratively includes switch 702 connected across a capacitor 704 and in series with a resistor 706. In the illustrated embodiment, switch 702 is a momentary pushbutton switch providing a voltage pulse to microcontroller 100 to select a mode of operation. In particular, with switch 702 open, fully charged capacitor 704 creates an open circuit by blocking current to microcontroller 100 and to resistor 706. Each time switch 702 is closed, a voltage pulse (interrupt signal) is provided to microcontroller 100 which, as a result of programming code instructions in memory 104, causes the illumination beacon 10 to turn on/off or to change modes of operation.

As illustrated in FIG. 12, the mode of operation of beacon 10 corresponds to the number of button presses of switch 702. When switch 702 is initially actuated, beacon 10 powers-up in a first mode, and status indicator 900 (see FIG. 1) flashes twice. Switch 702 may be actuated n times corresponding to n mode changes. At each mode change, status indicator 900 flashes once to indicate the changed operating mode of beacon 10.

Figure 13:
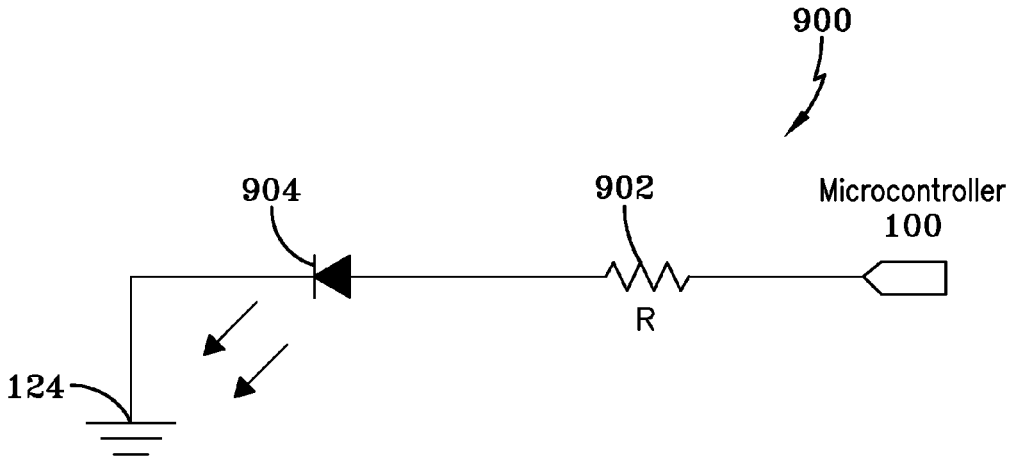
FIG. 13 is a schematic view of an illustrative status indicator of the operating system of FIG. 1.
Figure 14:
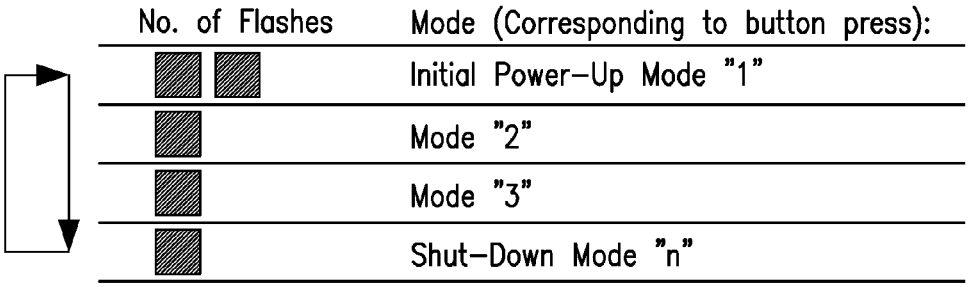
FIG. 14 is a table illustrating indicator status corresponding to operation of the mode select interface.

Referring to FIG. 13, an exemplary status indicator 900 is shown as including a resistor 902 in series with a visible light source, illustratively a light-emitting diode (LED) 904. An output voltage pulse from microcontroller system 100 illuminates LED 904. Referring to FIG. 14, LED 904 is configured to flash twice when beacon 10 is initially powered on and to flash once when the operating mode changes or when beacon 10 is powered down. Other flashing schemes may be implemented with status indicator 900 by reprogramming the microcontroller system 100.

The external trigger system 800 may comprise any one of a plurality of receivers for activating the illumination beacon 10 in response to an external trigger or stimuli. In one illustrative embodiment, the external trigger system 800 comprises a magnetic read switch 802. In another illustrative embodiment, the external trigger system 800 may comprise a laser trigger 804. The external trigger system 800 may also comprise other energy receivers, such as a radio frequency, infrared, or ultrasonic receiver. In other illustrative embodiments, the external trigger system may comprise a mechanical device, such as a pull tab which may be pulled by an operator to activate the illumination beacon 10.

Figure 15B:
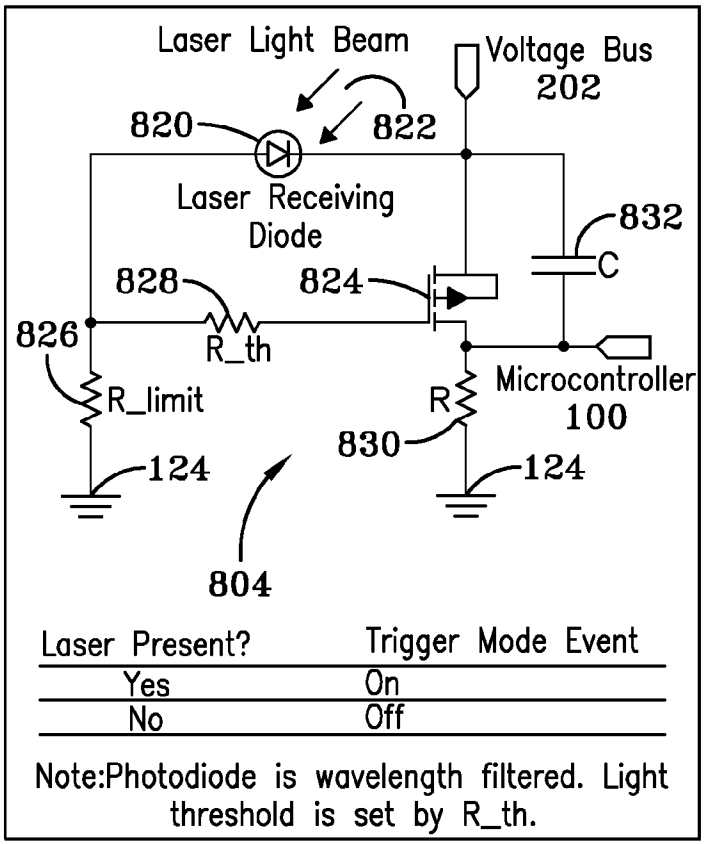
FIG. 15B is a schematic view of an illustrative laser trigger of the operating system of FIG. 1.
Figure 15A:
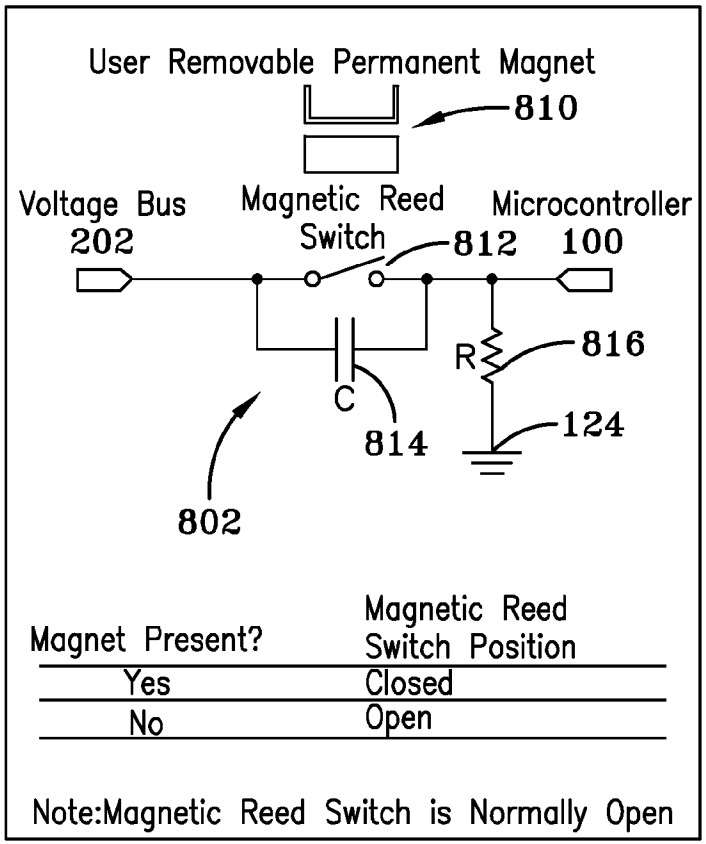
FIG. 15A is a schematic view of an illustrative magnetic reed switch of the operating system of FIG. 1.

Referring to FIG. 15A, an exemplary magnetic reed switch system 802 is shown connected between voltage bus 202 and an input of microcontroller 100. Magnetic reed switch system 802 illustratively includes a normally open reed switch 812 connected across a capacitor 814 and in series with a resistor 816. With reed switch 812 open, fully charged capacitor 814 creates an open circuit by blocking current to microcontroller 100 and to resistor 816. A permanent magnet 810 positioned in proximity to reed switch 812 causes reed switch 812 to close, thereby providing voltage from voltage bus 202 to the input of microcontroller 100. In one embodiment, when magnet 810 is moved away from reed switch 812 causing reed switch 812 to open, beacon 10 is powered on. Alternatively, closing reed switch 812 with magnet 810 may cause beacon 10 to power on, and moving magnet 810 away from reed switch 812, thereby opening reed switch 812, may cause beacon to power off. In one embodiment, magnetic reed switch system 802 may also be used to change operating modes of beacon 10.

Referring to FIG. 15B, an exemplary laser trigger system 804 includes a receiver configured to receive a light beam 822 from an external laser. In the illustrative embodiment, the receiver comprises a photodiode 820 coupled and a transistor 824. Photodiode 820 is configured to detect laser light beam 822. Transistor 824 is illustratively an enhancement mode, p-channel transistor. When a laser light beam 822 is detected by photodiode 820, a voltage pulse is provided to microcontroller to trigger an on/off event or a mode-changing event. In particular, photodiode 820 generates a current through resistor 828 upon detection of light 822. Depending on the resistance value of resistor 828, the current generated by photodiode 820 provides a voltage at the input of transistor 824. Upon the voltage at the input of transistor 824 reaching a predetermined value, transistor 824 provides voltage from voltage bus 202 to microcontroller system 100 to power on or to power off beacon 10. In one embodiment, laser trigger system 804 may also be used to change operating modes of beacon 10. As shown in the state diagram of FIG. 15B, when the laser light beam 822 is detected by the photodiode 820, the trigger mode event is determined by the microcontroller system 100 to be "on". When the photodiode 820 does not detect the laser light beam 822, the trigger mode event is determined by the microcontroller system 100 to be "off".

In certain illustrative embodiments, the laser source 822 may be used for IFF identification information and verification. For example, the beacon 10 may enter into an identification response mode where it relays back IFF information via the light sources 602 and 604. The laser source 822 may be of any wavelength as required, as long as receiver 820 matches the source's specific wavelength. The resistors 826, 828 and 830 are illustratively used to current limit the input signal of the receiver 820, either aid in amplification with transistor 824, or reduction of the signal depending on the application of use. Capacitor 832 illustratively conditions the input signal to the microcontroller 100 as a noise reduction device.

Figure 16:
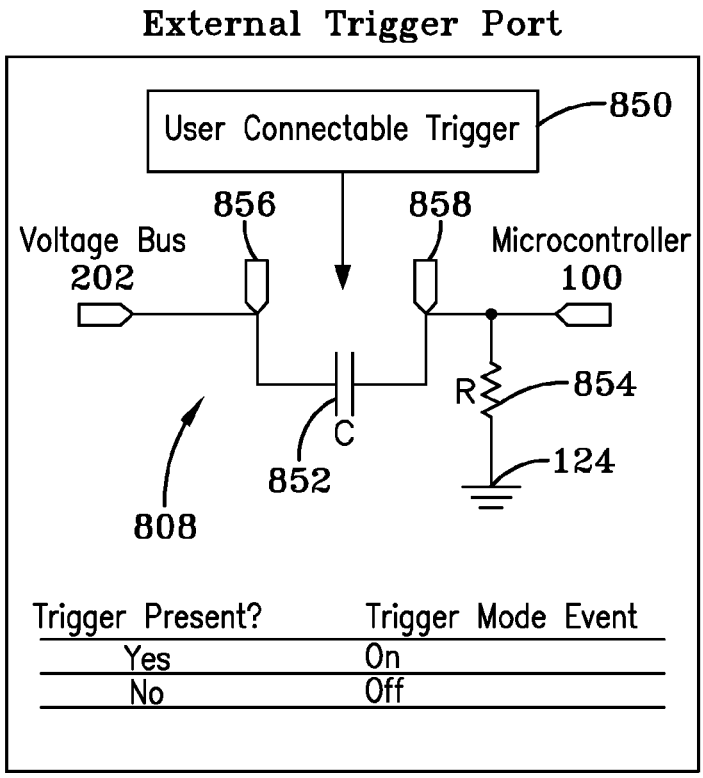
FIG. 16 is a schematic of an illustrative external trigger port of the operating system of FIG. 1.

Referring to FIG. 16, an exemplary external trigger port 808 is shown having a user-connectable trigger 850 connected across a capacitor 852 and in series with a resistor 854. Trigger 850 may include a removable pull-tab, a pull-string, or other suitable user-connectable trigger device. In the illustrated embodiment, when trigger 850 is connected between contacts 856 and 858, voltage from voltage bus 202 is provided to the input of microcontroller system 100. When trigger 850 is removed or pulled away from at least one of contacts 856, 858, a charged capacitor 814 creates an open circuit by blocking current to microcontroller 100 and to resistor 816.

Figure 17:
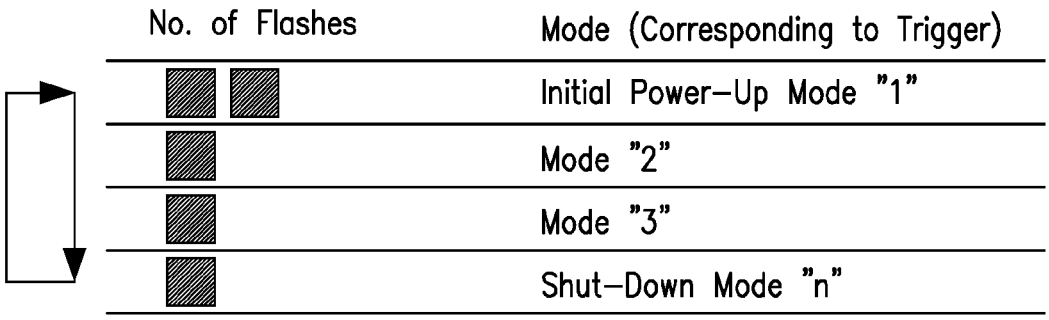
FIG. 17 is a table illustrating indicator status corresponding to operation of the external trigger of FIG. 16.

In the illustrated embodiment as shown in FIG. 17, removal or actuation of trigger 850 causes the illumination beacon 10 to activate and cause the emitters 602 and 604 to operate in a first mode, for example flashing at a first microcontroller system 100 defined rate or frequency and duration (i.e., enter a first power-up mode). Alternatively, removal or actuation of trigger 850 may cause beacon 10 to deactivate (i.e., enter a power off mode), or to change operating modes. In one illustrative embodiment, a first actuation of trigger 850 causes the illumination beacon 10 to enter the first power-up mode, a subsequent second actuation of trigger 850 causes the illumination beacon 10 to enter a second mode, for example flashing at a second microcontroller system 100 defined rate and duration (i.e., enter a second mode), and a subsequent third actuation of trigger 850 causes the illumination beacon 10 to enter a third mode, for example flashing at a third microcontroller system 100 defined rate and duration (i.e., enter a third mode). Additional subsequent actuations of trigger 850 may cause the illumination beacon 10 to enter an additional number of modes, as defined by the microcontroller system 100 as having predefined rates and durations, until the final "n" mode is achieved defining the power off mode.

Figure 18:
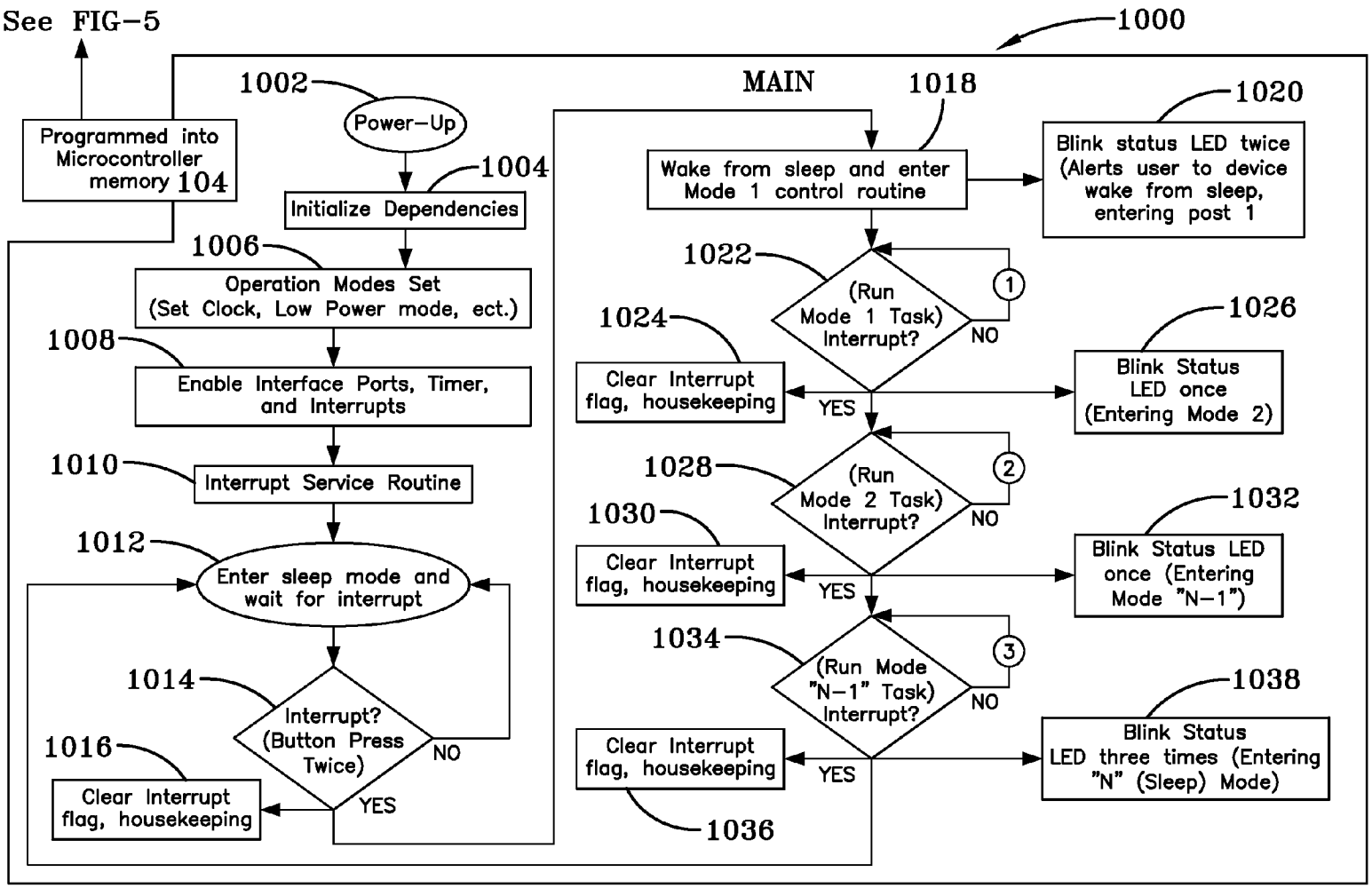
FIG. 18 is a flow chart of an illustrative method of operation of the illumination beacon of FIG. 1.

Referring now to FIG. 18, an illustrative method of operation of the illumination beacon 10 is shown. The method 1000 is illustratively performed by code instructions programmed into the microcontroller memory 104. The method illustratively begins at step 1002 where the microcontroller system 100 enters an initialization mode during initial power-up, illustratively during factory assembly by activating the illumination beacon 10 through either the mode select interface 700 or the external trigger system 800. The system dependencies are next initialized at step 1004. The system dependency initialization step 1004 refers to the manufacturers written drivers for the microcontroller device 100. These drivers allow for the interface from the code written in 1000 to command and control the hardware built into the microcontroller device 100.

The illustrative method 1000 continues to block 1006 wherein the microcontroller system 100 sets operation modes, including setting clock and low power mode. Operation modes 1006 refers to the various options provided by the microcontroller 100 manufacturer to allow or prevent specific operating modes. For example, clock setting refers to the clock speed at which the microcontroller 100 should operate in (illustratively Megahertz (Mhz)) and low power mode refers to whether or not the microcontroller 100 is allowed to operate with a lower source voltage.

Continuing at block 1008, the microcontroller system 100 enables interface ports, timer, and interrupts. At block 1010, an interrupt service routine is processed by the microcontroller system 100. An illustrative service interrupt routine corresponding to activation of the mode select interface 700 is shown in FIG. 12, while an illustrative interrupt service routine corresponding to activation of the external trigger system 800 is shown in FIG. 14. Block 1008 refers to the various options provided by the microcontroller 100 manufacturer to allow or prevent specific hardware inputs, outputs, timers and interrupt devices internal to the microcontroller 100. For example, the code in block 1008 may allow for the utilization of interface pins leading to the connected circuitry of microcontroller 100. Also a pin on the microcontroller 100 may be designated to wait for an input and interface with the interrupt service routine (also known as a hardware interrupt). Hardware interrupts are known in the art for interrupting a processor when it requires attention.

At block 1012, the microcontroller system 100 enters a sleep mode and waits for an interrupt signal at block 1014. At block 1014, if an interrupt signal is not received the microcontroller system 100 returns through a loop by returning to block 1012 and continues in the sleep mode. If an interrupt signal is received, illustratively through actuation of the mode select interface 700 or the external trigger system 800, then the microcontroller system 100 continues to block 1018 where the operating system 20 wakes from the sleep mode and enters the power-up or first mode. As detailed herein, in the first mode, the microcontroller system 100 illustratively causes the light sources 602 and 604 to emit light in a flashing pattern having a first defined rate and duration. At block 1020, the status indicator LED 904 illustratively flashes twice to provide a visible alert to the user that the device is no longer in the sleep mode and is active. Concurrently, at block 1016, the microcontroller system 100 clears the interrupt flag and conducts housekeeping procedures. Housekeeping procedures illustratively allow the code to wait once again for a button press (hardware interrupt event) by clearing the interrupt flag and memory bits to prepare the code for the next step.

The process continues at block 1022 where the microcontroller system 100 looks for an interrupt signal to the first mode. If an interrupt signal is not received the process 1000 returns through a loop to block 1022 and continues in the first mode for a predetermined time as measured by timer of the microcontroller system 100. If the microcontroller system 100 detects that the mode select switch 704 has been depressed when the operating system 20 is in the first mode, then at block 1028 the microcontroller system 100 enters the second mode. As detailed herein, this subsequent second actuation of either mode select interface 700 or trigger 850 causes the illumination beacon 10 to enter the second mode, where the light sources 602 and 604 flash at a second microcontroller system 100 defined rate and duration (i.e., enter a second mode). At block 1026, the status indicator LED 904 illustratively flashes once to provide a visible alert to the user that the illumination beacon 100 has changed modes. Concurrently, at block 1024, the microcontroller system 100 clears the interrupt flag and conducts housekeeping procedures.

The process continues at block 1028 where the microcontroller system 100 looks for an interrupt signal to the second mode. If an interrupt signal is not received the process 1000 returns through a loop to block 1028 and continues in the second mode for a predetermined time as measured by timer of the microcontroller system 100. If the microcontroller system 100 detects that the mode select switch 704 has been depressed when the operating system 20 is in the second mode, then at block 1034 the microcontroller system 100 enters a subsequent (i.e., third) mode. As detailed herein, this subsequent actuation of either mode select interface 700 or trigger 850 causes the illumination beacon 10 to enter the next mode, where the light sources 602 and 604 flash at a third microcontroller system 100 defined frequency and duration (i.e., enter a second mode). At block 1032, the status indicator LED 904 illustratively flashes once to provide a visible alert to the user that the illumination beacon 100 has changed modes. Concurrently, at block 1030, the microcontroller system 100 clears the interrupt flag and conducts housekeeping procedures.

The process 1000 may continue for any number of subsequent modes based upon code instructions in controller memory 104. At the microcontroller system 100 defined maximum number of modes N, the operating system illustratively returns to the sleep mode. For example, at block 1034 the microcontroller system 100 looks for an interrupt to the immediately preceding N−1 mode. More particularly, if the microcontroller system 100 detects that the mode select switch 704 has been depressed when the operating system 20 is in the preceding N−1 mode, then at block 1038 the microcontroller system 100 enters the N, illustratively sleep, mode. This subsequent actuation of either mode select interface 700 or trigger 850 N times, causes the illumination beacon 10 to enter the sleep mode, where the light sources 602 and 604 are deactivated, thereby conserving energy from the battery system 300. At block 1038, the status indicator LED 904 illustratively flashes three times to provide a visible alert to the user that the illumination beacon 100 has entered the sleep mode. Concurrently, at block 1036, the microcontroller system 100 clears the interrupt flag and conducts housekeeping procedures. The process 1000 then returns to block 1012 where the microcontroller system 100 enters the sleep mode and waits for an interrupt.

Figure 19:
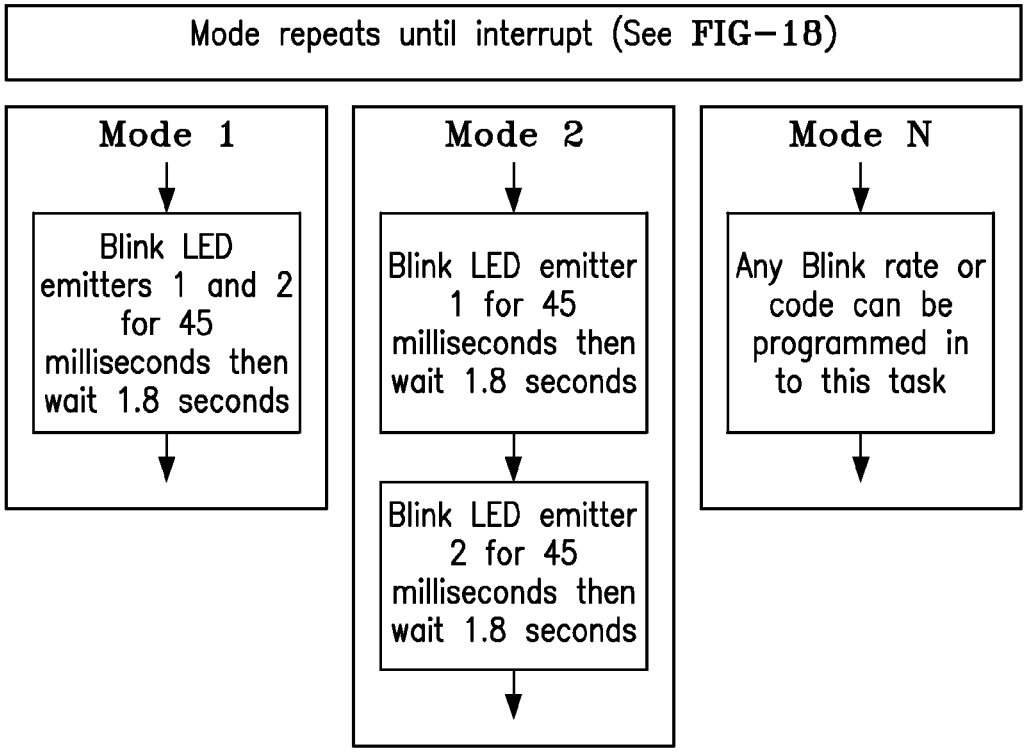
FIG. 19 is a state diagram of illustrative operating modes for the operating system of FIG. 1.

Referring now to FIG. 19, illustrative first, second, and N modes are shown. Illustratively, the first mode includes repeating the cycle of blinking LED emitters 602 and 604 for 45 milliseconds, then waiting 1.8 seconds. The second mode illustratively includes repeating the cycle of blinking LED emitters 602 for 45 milliseconds, waiting 1.8 seconds, blinking LED emitters 604 for 45 milliseconds, then waiting 1.8 seconds. The N mode may be customized by programming the microcontroller system 100. More particularly, any single or repeating cycle of LED 602 and 604 operation may be preprogrammed into the memory 104 of the microcontroller 100. Further, the microcontroller system 100 may be field or factory reprogrammed through use of the interface headers 114.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

The invention claimed is:

1. An illumination beacon comprising:

a housing including an arcuate outer wall, a transparent top surface, and a transparent bottom surface;

an upper mounting member supported within the housing intermediate the transparent top surface and the transparent bottom surface;

a lower mounting member supported within the housing intermediate the upper mounting member and the transparent bottom surface;

an upper light source supported by the upper mounting member and oriented to project light upwardly through the transparent top surface;

a lower light source supported by the lower mounting member and oriented to project light downwardly through the transparent bottom surface;

a driver system received within the housing and operably coupled to the upper and lower light sources, the driver system configured to activate the upper and lower light sources;

a controller received within the housing and operably coupled to the driver system, the controller configured to control operation of the driver system for activating the upper and lower light sources in a flashing manner;

a battery received within the housing intermediate the upper mounting member and the lower mounting member, the battery operably coupled to the driver system for providing power to the upper and lower light sources; and a power management system operably coupled to the battery, the power management system including a signal generator coupled to the battery and configured to generate first and second voltage signals, and an inductor coupled to the signal generator, the inductor selectively storing energy from the battery in response to the first voltage signal from the signal generator, and providing energy to power the upper and lower light sources in response to the second voltage signal to increase energy efficiency of the battery.

2. The illumination beacon of claim 1, further comprising a mode select interface operably coupled to the controller, the controller configured to select a flashing mode of the upper and lower light sources in response to input to the mode select interface.

3. The illumination beacon of claim 1, further comprising an external trigger system operably coupled to the controller, the controller configured to activate the light source in response to input to the external trigger system.

4. The illumination beacon of claim 3, further comprising a status indicator operably coupled to the controller and configured to project a visible light external to the housing in response to input from the external trigger system.

5. The illumination beacon of claim 1, wherein each of the upper and lower light sources comprises an infrared light emitter.

6. The illumination beacon of claim 1, wherein the upper and lower light sources each include a socket configured to interchangeably receive one of an infrared, ultraviolet, and visible light emitter.

7. The illumination beacon of claim 1, further comprising an external interface operably coupled to the controller and configured to receive signals from an external processor to control activation of the upper and lower light sources.

8. The illumination beacon of claim 1, wherein the housing comprises a puck including a cylindrical side wall coupling the top surface with the bottom surface.

9. The illumination beacon of claim 1, wherein the housing comprises a sphere.

10. The illumination beacon of claim 1, further comprising a battery holder positioned intermediate the upper mounting member and the lower mounting member, the battery holder including a positive terminal and a negative terminal, and the battery comprising a coin cell battery removably received within the battery holder for electrical communication with the positive terminal and the negative terminal.

11. The illumination beacon of claim 1, further comprising a battery charge system operably coupled to the battery and configured to receive external power to charge the battery.

12. The illumination beacon of claim 1, wherein the housing has an outer diameter of no greater than 1 inch.

13. The illumination beacon of claim 1, wherein the weight of the illumination beacon is no greater than 0.5 ounces.

14. An illumination beacon comprising:

a housing;

a mounting member supported within the housing;

a light source supported by the mounting member and oriented to project a non-visible light external to the housing;

a controller received within the housing and operably coupled to the light source, the controller configured to activate the light source in one of a plurality of flashing modes;

a battery received within the housing and operably coupled to the light source;

a mode select interface operably coupled to the controller, the controller configured to select a flashing mode of the light source in response to input to the mode select interface;

an external trigger system operably coupled to the controller, the controller configured to activate the light source in response to input to the external trigger system; and a status indicator operably coupled to the controller and configured to project a visible light external to the housing in response to input to at least one of the mode select interface and the external trigger system.

15. The illumination beacon of claim 14, further comprising a driver system received within the housing and operably coupled to the light source, the driver system configured to activate the light source in response to a signal received from the controller.

16. The illumination beacon of claim 14, further comprising a power management system operably coupled to the battery, the power management system including a signal generator and an energy storage device configured to selectively provide energy to the battery in response to a signal from the signal generator to increase energy available from the battery.

17. The illumination beacon of claim 14, wherein the mounting member includes an upper mounting member and a lower mounting member spaced apart from the upper mounting member, the battery positioned intermediate the upper mounting member and the lower mounting member.

18. The illumination beacon of claim 17, further comprising a battery holder positioned intermediate the upper mounting member and the lower mounting member, the battery holder including a positive terminal and a negative terminal, and the battery comprising a coin cell battery removably received within the battery holder for electrical communication with the positive terminal and the negative terminal.

19. The illumination beacon of claim 17, wherein the housing includes an outer wall with a center plane defined by a circle, the housing further including a transparent top surface and a transparent bottom surface.

20. The illumination beacon of claim 19, wherein the light source includes an upper light source supported by the upper mounting member and oriented to project light upwardly through the transparent top surface, and a lower light source supported by the lower mounting member and oriented to project light downwardly through the transparent bottom surface.

21. The illumination beacon of claim 19, wherein the external trigger system comprises a laser receiver configured to receive a signal from a laser source external to the housing.

22. The illumination beacon of claim 19, wherein the external trigger system comprises a reed switch configured to be controlled by a magnet external to the housing.

23. The illumination beacon of claim 19, wherein the external trigger system comprises a radio frequency receiver configured to receive a signal from a radio frequency transmitter external to the housing.

24. The illumination beacon of claim 14, wherein the light source comprises one of an infrared and ultraviolet light emitter.

25. The illumination beacon of claim 14, wherein the light source includes a socket configured to interchangeably receive one of an infrared, ultraviolet, and visible light emitter.

26. The illumination beacon of claim 14, further comprising a battery charge system operably coupled to the battery and configured to receive external power to charge the battery.

27. An illumination beacon comprising:

a housing including an outer wall with a center plane defined by a circle, the housing further including a transparent top surface and a transparent bottom surface;

an upper mounting member supported within the housing intermediate the transparent top surface and the transparent bottom surface;

a lower mounting member supported within the housing intermediate the upper mounting member and the transparent bottom surface;

an upper light source supported by the upper mounting member and oriented to project light upwardly through the transparent top surface;

a lower light source supported by the lower mounting member and oriented to project light downwardly through the transparent bottom surface;

a controller received within the housing and operably coupled to the upper and lower light sources, the controller configured to control operation of the upper and lower light sources in a flashing manner;

a battery holder positioned intermediate the upper mounting member and the lower mounting member, the battery holder including a positive terminal and a negative terminal;

a coin cell battery removably received within the battery holder for electrical communication with the positive terminal and the negative terminal for providing power to the upper and lower light sources; and wherein the housing has an outer diameter of no greater than 1 inch.

28. The illumination beacon of claim 27, wherein the housing comprises a puck including a cylindrical side wall coupling the top surface with the bottom surface.

29. The illumination beacon of claim 28, wherein the housing has a thickness no greater than 0.5 inches.

30. The illumination beacon of claim 27, wherein the housing comprises a sphere.

31. The illumination beacon of claim 27, wherein the weight of the illumination beacon is no greater than 0.5 ounces.

32. The illumination beacon of claim 27, further comprising a mode select interface operably coupled to the controller, the controller configured to select a flashing mode of the upper and lower light sources in response to input to the mode select interface.

33. The illumination beacon of claim 27, further comprising an external trigger system operably coupled to the controller, the controller configured to activate the light source in response to input to the external trigger system.

34. The illumination beacon of claim 33, further comprising a status indicator operably coupled to the controller and configured to project a visible light external to the housing in response to input from the external trigger system.

35. The illumination beacon of claim 27, wherein each of the upper and lower light sources comprises an infrared light emitter.

36. The illumination beacon of claim 27, further comprising a power management system operably coupled to the battery, the power management system including a signal generator and an energy storage device configured to selectively provide energy to the battery in response to a signal from the signal generator to increase energy available from the battery.

37. A method of providing a light signal, the method comprising the steps of:

providing a housing, a light source within the housing, and a status indicator within the housing;

providing an input to a mode select interface;

illuminating the status indicator to project a visible light external to the housing;

illuminating the light source to project a non-visible light external to the housing in one of a plurality of different flashing patterns based upon the input to the mode select interface;

supplying power to the status indicator and the light source from a battery; and generating voltage signals, storing energy from the battery in an energy storage device in response to a first voltage signal; and supplying energy from the energy storage device to the status indicator and the light source in response to a second voltage signal.

38. The method of claim 37, wherein the step of illuminating the light source includes the step of activating an infrared light emitting diode to project light through a transparent surface of the housing.

39. The method of claim 37, further comprising the step of triggering an external trigger system received within the housing to activate the light source.

40. The method of claim 39, wherein the triggering step comprises receiving a signal from a laser source external to the housing.

41. The method of claim 39, wherein the triggering step comprises moving a magnet external to the housing to control a reed switch received within the housing.

42. The method of claim 39, wherein the triggering step comprises receiving a signal from a radio frequency transmitter external to the housing.

43. The method of claim 37, further comprising the step of interchanging the light source from between any one of an infrared light emitter, an ultraviolet light emitter, and a visible light emitter.

44. The method of claim 37, further comprising the step of coupling an external power source to the housing for charging the battery.

* * * * *